US005441318A

United States Patent [19]

Ghostley

[11] Patent Number: 5,441,318

[45] Date of Patent: Aug. 15, 1995

[54] LEVER OPERATED DOOR LOCK ASSEMBLY

[75] Inventor: Thomas J. Ghostley, Anaheim, Calif.

[73] Assignee: Emhart Inc., Newark, Del.

[21] Appl. No.: 320,796

[22] Filed: Oct. 7, 1994

Related U.S. Application Data

[63] Continuation of Ser. No. 928,600, Aug. 13, 1992, abandoned.

[51] Int. Cl.[6] ..... E05B 3/00

[52] U.S. Cl. ..... 292/336.3; 292/350; 292/356

[58] Field of Search ..... 292/336.3, 359, 348, 292/353, 336.5, DIG. 30, 347, 356, 357, 169.22, 169.23, 350, 169.16, 169.21, 358; 70/224

[56] References Cited

U.S. PATENT DOCUMENTS

| | | | |
|---|---|---|---|
| 535,050 | 3/1895 | Cooley | 292/350 X |
| 671,018 | 4/1901 | Gonne | 292/358 |
| 2,510,746 | 6/1950 | Kleeberg | 292/169.23 |
| 2,741,502 | 4/1956 | Crandell | 292/348 |
| 2,795,948 | 6/1957 | Rayburn | 292/169.22 X |
| 2,998,273 | 8/1961 | Unetic . | |
| 3,026,136 | 3/1962 | Russell et al. | 292/336.3 |
| 3,390,910 | 7/1968 | Kuchler | 292/336.3 |
| 3,896,645 | 7/1975 | Nagy et al. | 292/348 X |
| 3,955,387 | 5/1976 | Best et al. . | |
| 4,223,929 | 9/1980 | Lint . | |
| 4,236,396 | 12/1980 | Surko, Jr. et al. | 292/356 X |
| 4,728,133 | 3/1988 | Valley | 292/357 X |
| 4,876,866 | 10/1989 | Fleming et al. | 292/336.5 X |
| 5,005,886 | 4/1991 | Carroll . | |
| 5,125,696 | 6/1992 | Robida et al. . | |

FOREIGN PATENT DOCUMENTS

| | | | |
|---|---|---|---|
| 359033 | 5/1929 | Belgium . | |
| 404392 | 11/1909 | France | 292/350 |
| 74544 | 12/1960 | France . | |
| 1570734 | 6/1969 | France . | |
| 2378924 | 9/1978 | France | 292/356 |
| 309661 | 12/1918 | Germany | 292/348 |
| 2418180 | 1/1975 | Germany | 292/356 |
| 2337873 | 2/1975 | Germany . | |
| 2435359 | 2/1976 | Germany | 292/353 |
| 2601759 | 7/1977 | Germany | 292/348 |
| 595110 | 11/1947 | United Kingdom | 292/348 |
| 822567 | 10/1959 | United Kingdom | 292/348 |

*Primary Examiner*—Rodney M. Lindsey
*Attorney, Agent, or Firm*—Spencer T. Smith

[57] ABSTRACT

A lever door lockset 20 includes an exterior subassembly 21 and an interior subassembly 55. Interior subassembly 55 includes a lever 56 positioned on an insert 62 which supports a rose insert 64. A half-round spindle 78 and a round spindle 80 are positioned through a spring biasing arrangement including spring 76 and through a bearing 88 supported by a shield 86. Shield 86 is assembled with rose insert 64. Exterior subassembly 21 includes a lever 22 which is assembled with an insert 24. A rose insert 32, a spring biasing arrangement including spring 40 and a cover 48 are mounted in assembly on insert 24. A latch assembly 94 including latch bolt 96 is coupled through half-round spindle 78 to levers 22 and 56 for movement of bolt 96 upon movement of the levers.

4 Claims, 5 Drawing Sheets

LEVER OPERATED DOOR LOCK ASSEMBLY

This is a continuation of application Ser. No. 07/928,600 filed on Aug. 13, 1992 now abandoned.

BACKGROUND OF THE INVENTION

This invention relates to a lever operated door lock assembly and particularly relates to lever operated assembly which allows for the changing of the hand of the related door with continued use of the existing levers.

In some currently available lever operated lock assemblies, the lever is constructed for direct assembly with elements within the lock assembly for subsequent operation of an associated bolt operating mechanism and bolt. By use of such levers, each lever has to be designed for a dedicated function. For example, the lever is designed to function as an interior lever or an exterior lever. Also, the lever is designed to function with a left hand door or a right hand door. For example, a left hand door is a door which is hinged on the left side as viewed from the exterior thereof. Thus, several options must be considered when designing a lever for direct assembly with the lock assembly.

Further, due to the above-noted requirement for different lever designs, multiple manufacturing facilities, warehouse storage facilities and retail counter space will be required thereby resulting in an overall lever-supply program which is costly and burdensome.

Thus, there is a need for a lever for use with a door lock assembly which will overcome the problems encountered with currently available levers as noted above.

SUMMARY OF THE INVENTION

In light of the need expressed above, it is an object of this invention to provide a lever operated door lock assembly which is versatile in design for assembly at any typical location on a door.

Another object of this invention is to provide a lever of common design which can be used at any typical location on a door and thereby eliminate the costly and burdensome efforts required for multiple designs of levers, each for a dedicated function.

With these and other objects in mind, this invention contemplates a door lock assembly for assembly with a door which includes a latch bolt and a bolt operating mechanism coupled to the bolt. A driver is coupled to the bolt operating mechanism. A lever is movable between a nonoperative position and an operative position and is attached to the driver so that, upon movement of the lever away from the non-operative position, the driver is moved to operate the bolt operating mechanism and thereby to move the latch bolt. A biasing element is coupled to the driver for developing a biasing force upon operation of the lever, the force being sufficient to return the lever to the non-operative position.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 1:
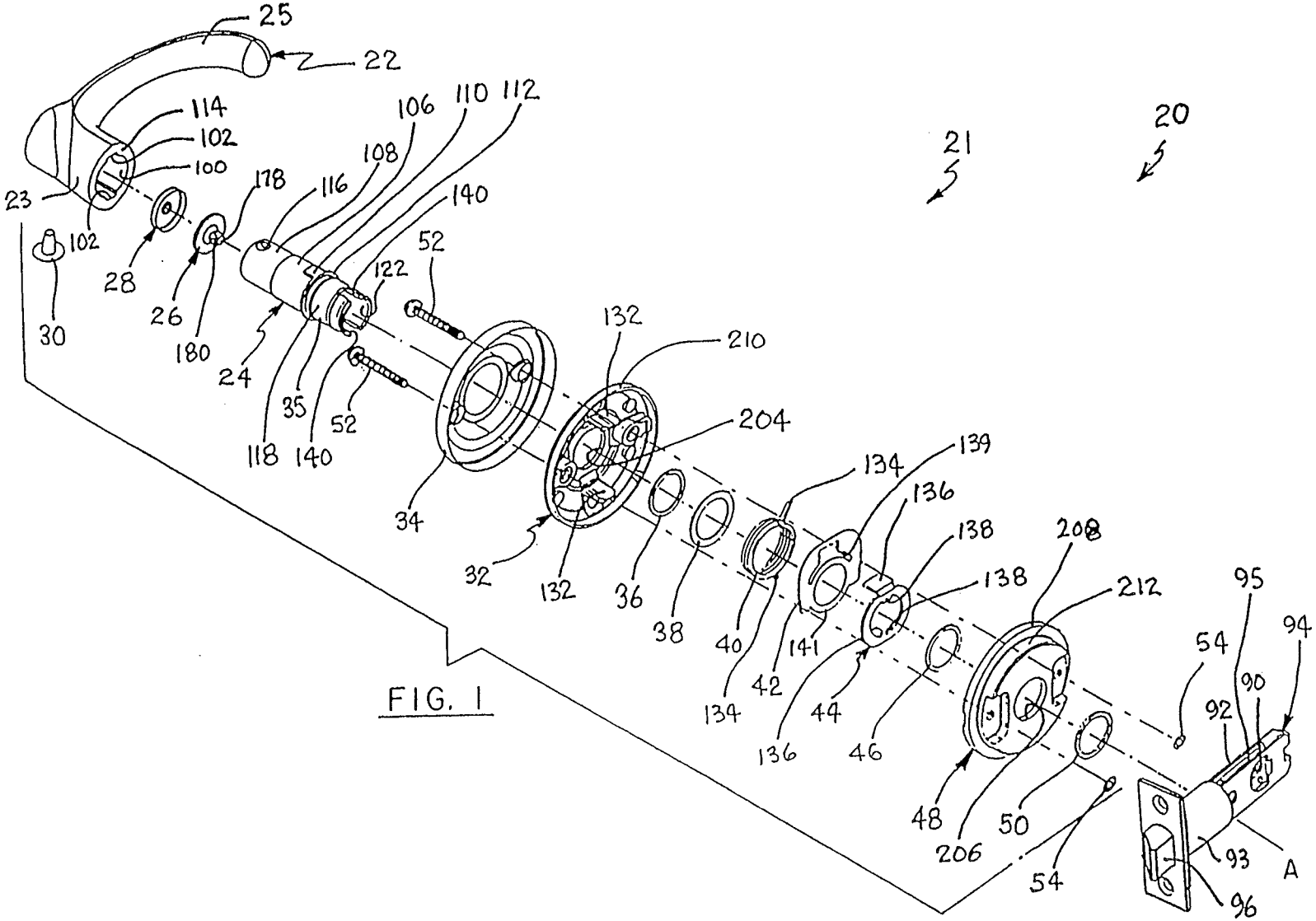
FIGS. 1 and 2 are exploded views which, when combined, illustrate elements of a lock assembly embodying certain principles of the invention.
Figure 2:
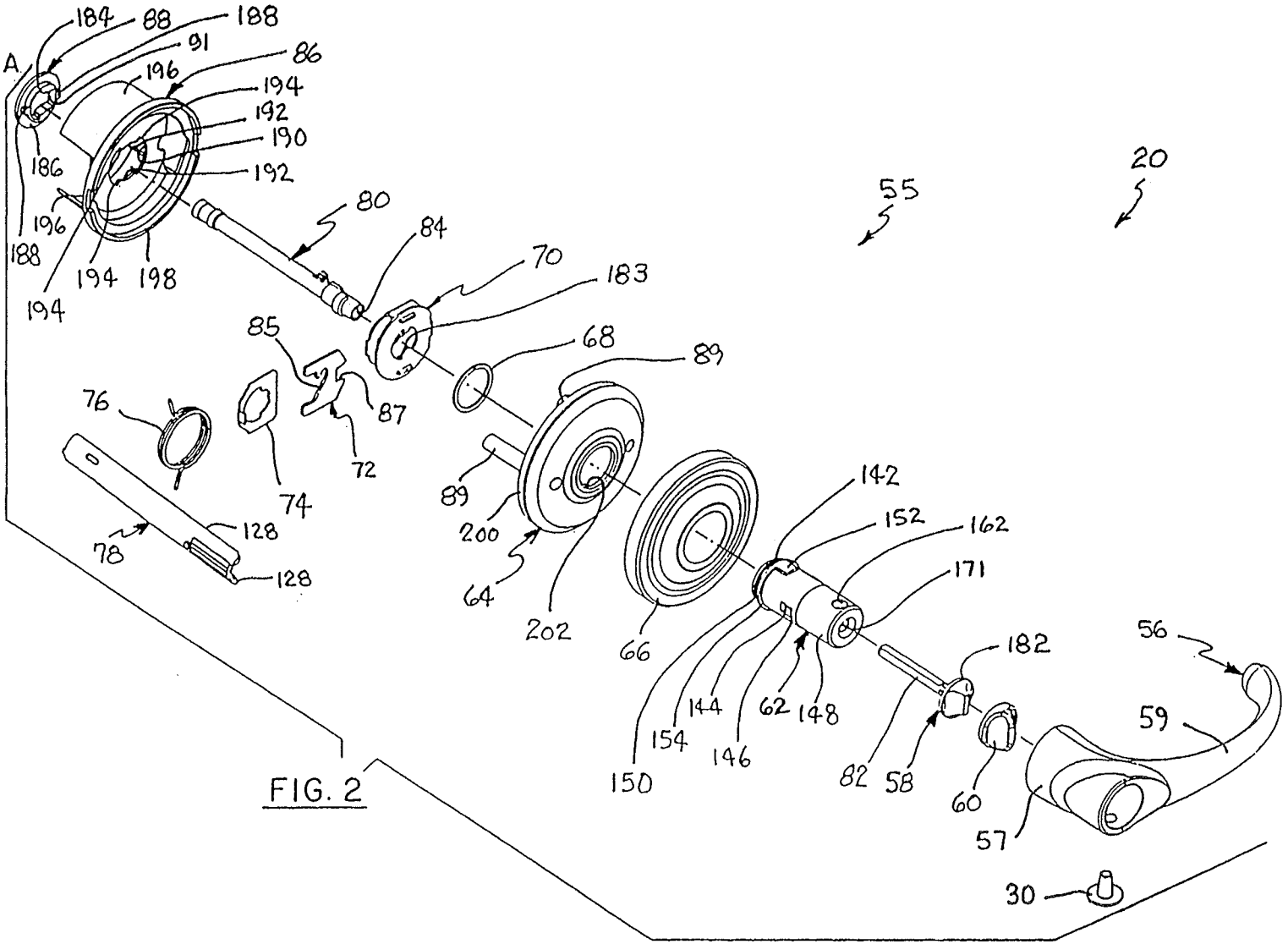

FIGS. 1 and 2 illustrate collectively an exploded view of a lock assembly such as lockset 20. To illustrate the complete exploded view of lockset 20, FIGS. 1 and 2 are to be linked at centerline arrowheads "A" of each figure.

As shown in FIG. 1, an exterior lever subassembly 21 includes a lever 22 which is formed with a hub 23 and an integral handle 25 and which is positioned for assembly with a lever insert 24 and an emergency plug 26 and cover 28. A cap 30 is to be assembled temporarily with lever 22 and insert 24 until a set screw (not shown) is assembled with the lever and insert to facilitate attachment thereof.

A rose insert 32 and cover 34 are positionable over an adjacent end 35 of insert 24 and held there by retaining ring 36. A washer 38, torque spring 40, stop plate 42 and housing 44 are also assembled on the adjacent end 35 of insert 24 and held there by retaining ring 46. A cover 48 is further placed on end 35 and held there by retaining ring 50.

Screws 52 are inserted through aligned openings of the rose insert 32 and cover 34 and further through openings in cover 48 and are held there by a pair of screw retainers 54 which completes assembly 21.

As viewed in FIG. 2, an interior lever subassembly 55 includes a lever 56 which is formed with a hub 57 and an integral handle 59 and which is positioned to receive a turnbutton insert 58 with a cover 60. Lever 56 is positionable onto a lever insert 62. A rose insert 64 and cover 66 are positioned on the inboard end of insert 62 and held there by retaining ring 68.

A locking housing 70 supports a locking slide 72, a detent slide 74 and a detent torque spring 76. A half-round spindle 78 is nested partially around a round spindle 80 and both spindles are inserted through an axial opening of housing 70. Turnbutton insert 58 is formed with a square shank 82 which is inserted into a square hole 84 of round spindle 80. The turnbutton insert 58 can be rotated to rotate round spindle 80. This results in adjustment of the components within housing 70 to, in effect, lock the lockset 20 and preclude it from being operated by either lever 22 or lever 56. For example, a cam surface (not shown) on round spindle 80 is moved when turnbutton insert 58 is rotated to engage a ramp surface 85 on slide 72 to move the slide so that a notch 87 thereof is positioned about a base of an adjacent one of a pair of threaded posts 89. This prevents movement of either of levers 22 and 56 to effectively lock lockset 20.

A security shield 86 has a central opening which supports a bearing 88 for limited rotation therein. Shield 86 is positioned against the inside of rose insert 64 with half-round spindle 78 and round spindle 80 located through an opening 91 in bearing 88 to complete assembly 55. Round spindle 80 is free to rotate relative to bearing 88. Half-round spindle 78 rotates the bearing 88 within its mount on shield 86 to the limits allowed by interfering structure on the bearing and shield. This limited movement of bearing 88 establishes the limits of rotation of half-round spindle 78.

As shown in FIGS. 1 and 2, half-round spindle 78 passes through an opening 90 formed in a stationary frame 92 of a latch assembly 94 and facilitates retracting movement of a bolt 96 of the assembly. In particular, bolt 96 is mounted within a case 93 and is spring-biased outwardly as shown in FIG. 1. A slide 95 is mounted slidably within frame 92. When half-round spindle 78 is rotated, slide 93 is moved in a direction away from case 91 resulting in movement of a latch cam (not shown) within the case. Latch cam moves a pair of followers (not shown) to move a bolt extender (not shown), all within case 91 to thereby retract bolt 96.

Rose insert 64 is formed with the pair of internally threaded posts 89 to receive screws 52 to draw and hold the lever lockset 20 in assembly with the door (not shown).

Figure 3:
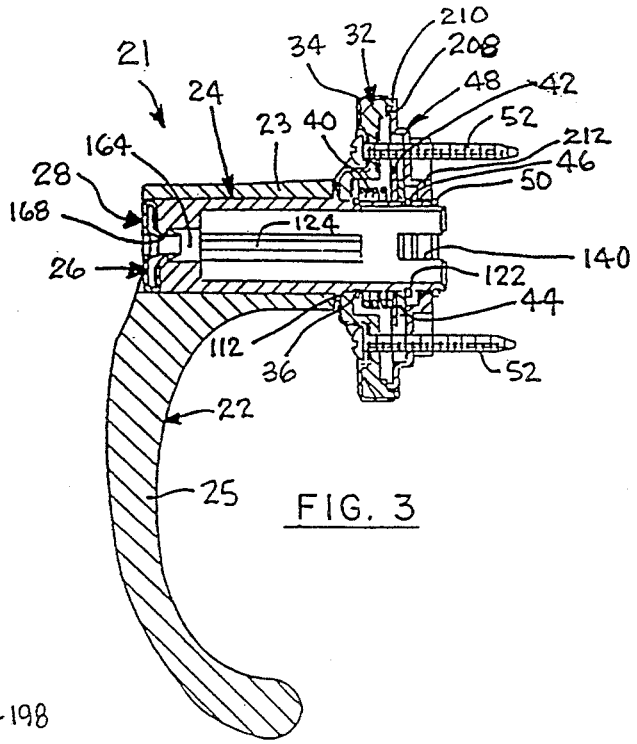
FIG. 3 is a sectional view of an exterior subassembly of the lock assembly of FIG. 1 embodying certain principles of the invention.
Figure 4:
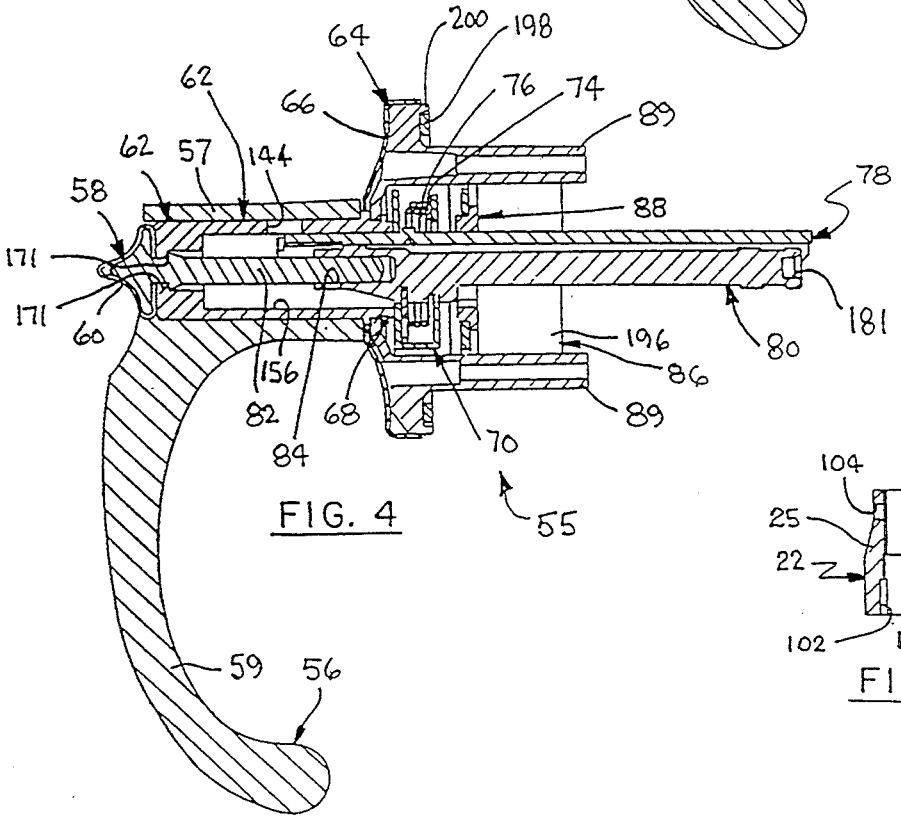
FIG. 4 is a sectional view of an interior subassembly of the lock assembly of FIG. 1 embodying certain principles of the invention.

FIG. 3 illustrates an assembly view of exterior lever assembly 21 while FIG. 4 illustrates an assembly view of interior lever assembly 55.

Initially, exterior lever assembly 21 (excluding lever 22), interior lever assembly 55 (excluding lever 56) and latch assembly 94 are assembled with the door.

Figure 5:
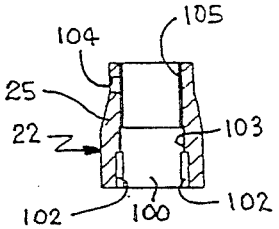
FIG. 5 is a sectional view of a portion of a lever of the lock assembly of FIG. 1 embodying certain principles of the invention.

As shown in FIGS. 1 and 5, lever 22 is formed with an opening 100 having diametrically opposed grooves 102 formed therein. Also, lever 22 is formed with a lateral through hole 104 to facilitate initial assembly of cap 30 and, later, of the set screw as noted above. Further, opening 100 is formed with a prescribed diameter in a portion 103 including grooves 102 and a slightly smaller diameter than the prescribed diameter in a remaining portion 105 of the hole.

As shown in FIGS. 1 and 6 through 10, exterior lever insert 24 is formed with a central cylindrical portion 106 and an outer cylindrical portion 108 of a diameter slightly less than the diameter of the central cylindrical portion. A pair of lugs 110 are formed in diametrically opposite locations on the periphery of central cylindrical portion 106 and blend integrally with an annular flange 112 formed at the inner end of the central cylindrical portion. Flange 112 is formed with a diameter greater than the diameter of central cylindrical portion 106.

Lever 22 is moved so that opening 100 thereof is positioned over cylindrical portions 106 and 108 of insert 24. Lugs 110 are guided into grooves 102 to properly orient lever 22 with respect to insert 24. Eventually flange 112 engages a face 114 (FIG. 1) of lever 22 to prevent further movement of lever 22 onto insert 24. It is noted that the stepped diameters of portions 106 and 108 of insert 24 fit frictionally into the complementary stepped diameters of portions 103 and 105, respectively, of hole 100 of lever 22.

As insert 24 is seated in hole 100 of lever 22, lever hole 104 is automatically aligned with one of two set screw receptacles 116 formed on diametrically opposite sides of outer cylindrical portion 108. In view of the symmetry of insert 24, either receptacle 116 may be aligned with lever hole 104.

As viewed in FIGS. 1, 7, 8, and 9, an inboard cylindrical portion 118 of insert 24 is formed with three axially spaced annular grooves 120 for receipt of retaining rings 36, 46 and 50 as described above.

Figure 8:
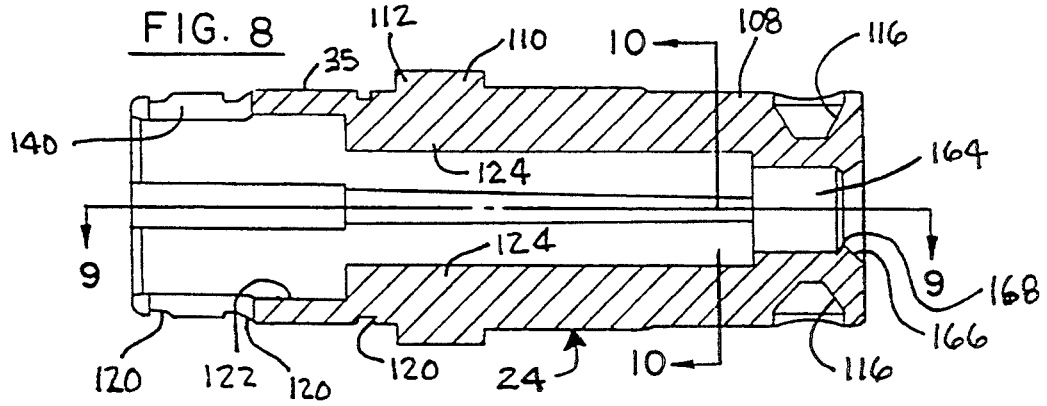
FIG. 8 is a sectional view taken along line 8—8 of FIG. 6 of the insert of FIG. 6.
Figure 7:
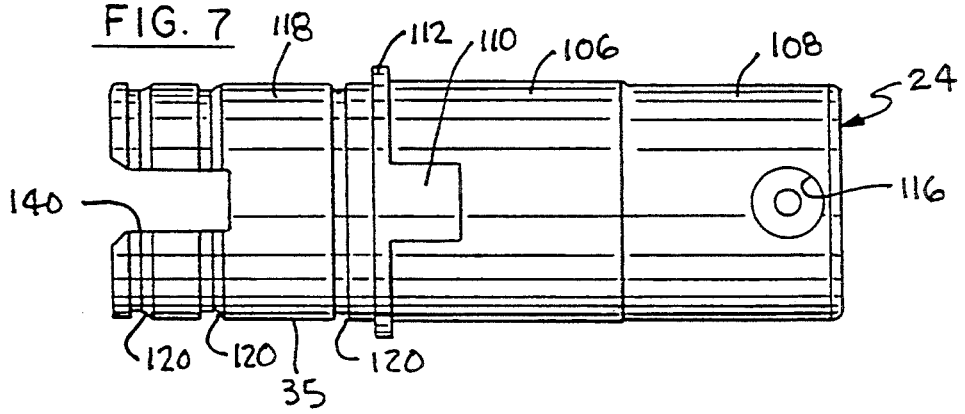
FIG. 7 is a side view of the insert of FIG. 6.
Figure 6:
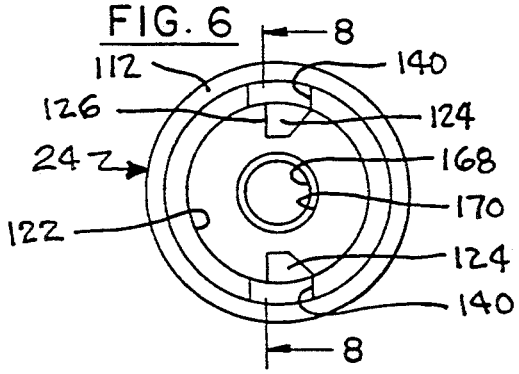
FIG. 6 is an end view of a first insert which supports a lever of the exterior subassembly of FIG. 3 for movement with the insert at an exterior portion of the subassembly and also supports interior portions of the subassembly all in accordance with certain principles of the invention.
Figure 10:
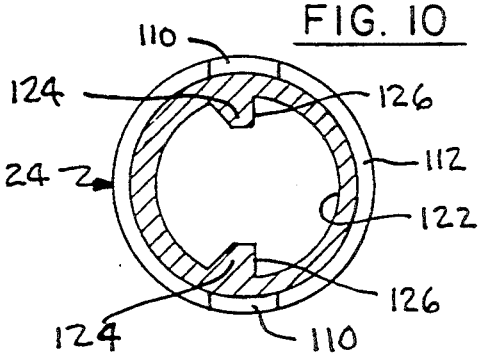
FIG. 10 is a sectional view taken along line 10—10 of FIG. 8 of the insert of FIG. 6.

Insert 24 is formed with an axial hole 122 for receipt of one end of half-round spindle 78 (FIG. 2). As shown in FIGS. 6, 8 and 10, a pair of diametrically spaced rails 124 are formed in the axial direction within hole 122 of insert 24 and provide shoulders 126 (FIG. 10) for engagement with outer edges 128 (FIG. 2) of half-round spindle 78. In this manner, when lever 22 is rotated, one of the shoulders 126 will engage an adjacent one of the edges 128 to move half-round spindle 78 and thereby retract bolt 96 of latch assembly 94.

AS viewed in FIG. 1, a pair of spaced tabs 132 extend inwardly from an inner face of rose insert 32 and are located to engage extended ends 134 of spring 40. In assembly, a pair of axially directed tabs 136 of housing 44 extend through and past stop plate 42 and into position adjacent ends 134 of spring 40. Housing 44 is also formed with a pair of radially projecting lugs 138 which are located within a pair of diametrically opposed, axially directed slots 140 (FIGS. 1, 7 and 8) formed in an inner end of insert 24.

As lever 22 is operated, insert 24 is rotated and, through lugs 138, drives or rotates housing 44. One of the tabs 136 engages an adjacent one of the ends 134 at the extreme ends of a slot 139 or arcuate surface 141 of spring 40. Upon continued operation of lever 22, spring 40 is tensioned. Eventually, tabs 136 engage stop surfaces of stop plate 42 which limits the travel of housing 44 and lever 22. Upon release of lever 22, tensioned spring 40 will facilitate return of the lever to its home position.

Figure 11:
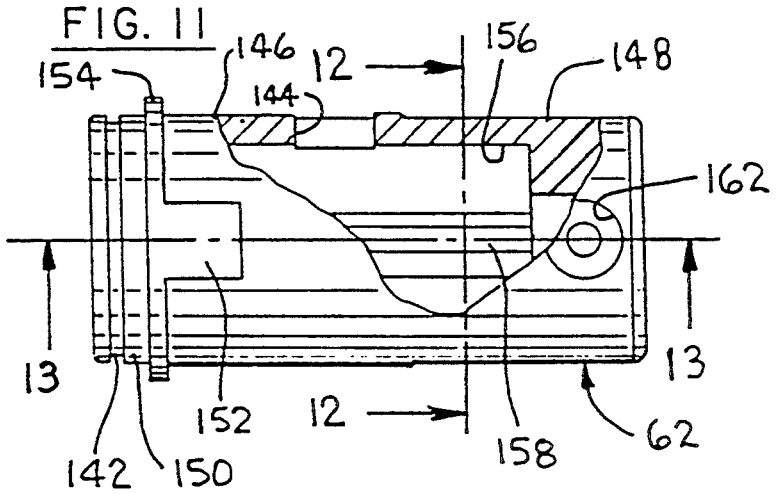
FIG. 11 is a side view with parts broken away of a second insert which supports a lever of the interior subassembly of FIG. 4 for movement with the insert at an exterior portion of the subassembly and also supports interior portions of the subassembly all in accordance with certain principles of the invention.
Figure 12:
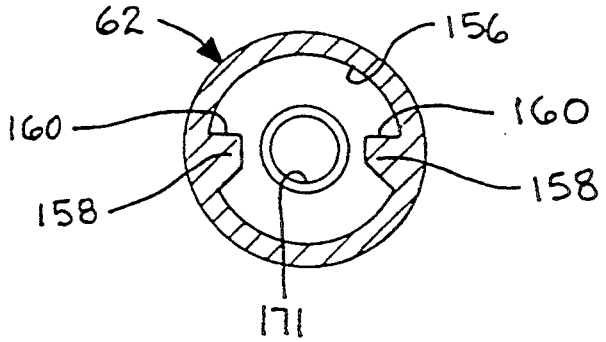
FIG. 12 is a sectional view taken along line 12—12 of FIG. 11 showing the second insert.

As viewed in FIG. 2, lever 56 is a mirror image of lever 22 (FIG. 1) and is structured internally in similar fashion. Further, as viewed in FIGS. 11, 12 and 13 lever insert 62 is similar in structure to lever insert 24 (FIG. 1) except that insert 62 is shorter and has a single annular groove 142 only for receipt of single retaining ring 68. Also, insert 62 is formed with a through hole 144 in a central cylindrical portion 146 thereof for receipt of a tab on spindle 78 in the event that such a tab is to be used.

Lever insert 62 is further formed with an outboard cylindrical portion 148 of slightly less diameter than the diameter of cylindrical portion 146. Also, insert 62 is formed with a short inboard cylindrical portion 150 in which is formed groove 142. A pair of diametrically spaced lugs 152 and an annular flange 154 are formed on the periphery of central portion 146 at the inboard end thereof. Insert 62 is formed with an axial opening 156 in which is formed with a pair of diametrically spaced rails 158 (FIG. 12) having shoulders 160. Further, insert 62 is formed with a pair of diametrically opposed set screw receptacles 162. The functions of these elements are consistent with the functions of similar elements associated with lever 22 and as described above.

It is noted that the dimensional and configurational character of insert 62 as viewed from flange 154 to the outboard end of insert 62 is the same as that of insert 24 as viewed from flange 112 to the outboard end of insert 24. Thus, each of the inserts 24 and 62 presents the same assembly configuration to levers 22 and 56.

Figure 9:
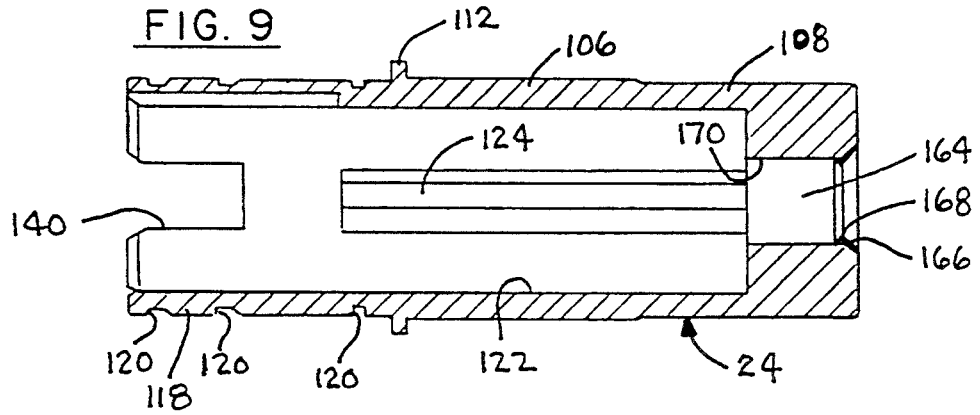
FIG. 9 is a sectional view taken along line 9—9 of FIG. 8 of the insert of FIG. 6.
Figure 13:
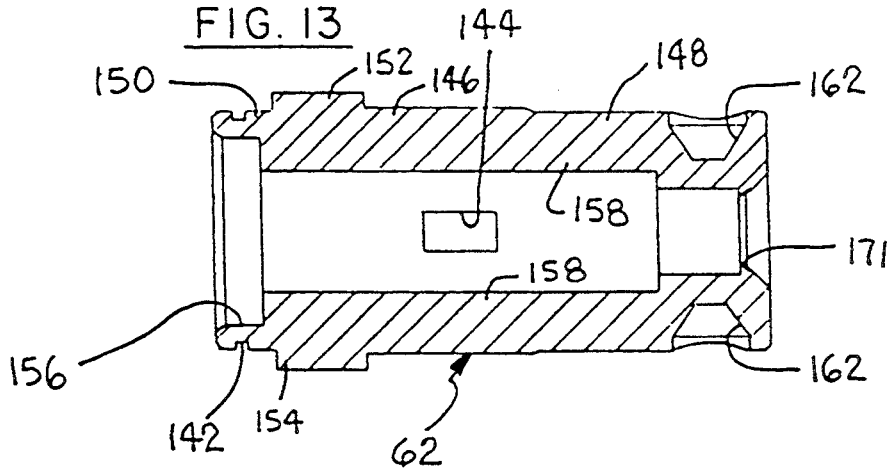
FIG. 13 is a sectional view taken along line 13—13 of FIG. 11 showing a portion of the second insert.

As shown in FIGS. 8 and 9, insert 24 is formed at its outer end with an axial opening 164. Opening 164 is formed by a countersunk portion 166, a radially inwardly-projecting rib 168 and a hole 170 of a diameter larger than the diameter of facing portions of the rib. In this fashion, rib 168 forms a circular fence within opening 164. In similar fashion, a rib 171 is formed in insert 62 (FIG. 13).

Figure 14:
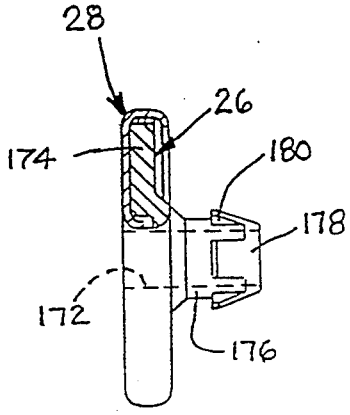
FIG. 14 a partial sectional view showing a cover for assembly with a lever as illustrated in FIG. 3.

As shown in FIGS. 1 and 14, emergency plug 26 is formed with an axial opening 172 which extends through a cap 174 and a stem 176 thereof. A locking element 178 is attached or formed to the free end of stem 176. Element 178 includes a plurality of flexible locking tabs 180 which are flared radially outwardly from the free end of stem 176 toward cap 174. Cover 28 is shown in assembly with cap 174 of emergency plug 26.

When assembling plug 26 with insert 24, stem 176 is inserted into opening 164 whereby tabs 180 engage rib 168 and are flexed radially inwardly thereby. Eventually, tabs 180 clear rib 168 and return to the position illustrated in FIG. 14 whereby the tabs and the rib retain plug 26 with insert 24 as shown in FIG. 3. Hole 172 provides probing access to an end 181 (FIG. 4) of round spindle 80.

By using the arrangement with emergency plug 26, lever 22 can be designed generically for all types of intended use of a given hand (left or right) instead of requiring many species types of levers each designed for a single dedicated use. It is noted that insert 62 for use with lever 56 is also formed in a fashion identical to insert 24. Thus, insert 62 receives and retains a head 182 (FIG. 2) of turnbutton insert 58 in the same manner that insert 24 receives and retains emergency plug 26.

Referring to FIGS. 2 and 4, half-round spindle 78 is positioned through a complementary shaped portion of a hole 183 formed through housing 70. As lever 56 is operated, half-round spindle 78 is rotated to cause rotation of housing 70. As housing 70 is rotated one or the other of ends 134 of spring 40 are moved by engaging structure of the housing whereby the spring is tensioned. Upon release of lever 56, tensioned spring 40 will facilitate return of the lever to its home position.

Referring further to FIGS. 2 and 4, bearing 88 is formed with a round hub 184 through which is formed opening 91. Also, bearing 88 is formed with a round flange 186 of diameter greater than the diameter of hub 184. A pair of lugs 188 extend radially outwardly from hub 184 and adjacent a side wall of flange 186. Hub 184 is positioned within an opening 190 of shield 86 for rotation between spaced curved surfaces 192 of the shield. Lugs 188 are thereby positioned to engage selected ones of a plurality of stop surfaces 194 also located in opening 190. Bearing 88 is frictionally positioned onto and over half-round spindle 78 with flange 186 being pressed against adjacent portions of shield 86 to hold the shield in place within interior lever subassembly 55.

Shield 86 is further formed with a pair of spaced curved deflectors 196 which shields the bolt operating mechanism from external tampering, for example, by placement of a probe through the hole (not shown) formed normally in the door for receipt of lockset 20. Also, deflectors 196 fit into the opening formed in the door for receipt of lockset 20 and preclude radially lateral movement of shield 86.

Shield 86 is also formed with a flange 198 which fits into an overhanging rim 200 of rose insert 64 as viewed in FIG. 4. This precludes radially lateral movement of shield 86 and rose insert 64 relative to each other. An opening 202 formed in rose insert 64 is positioned about inboard cylindrical portion 150 of lever insert 62 and serves as a first bearing support for interior lever assembly 55. Likewise, shield 86 together with bearing 88, which is positioned about half-round spindle 78, serve as a second bearing support for interior lever subassembly 55 which is spaced inboard of the first bearing support.

As viewed in FIGS. 1 and 3, rose insert 32 is formed with an opening 204 which is positioned on lever insert 24 as noted above and provides a first bearing support for exterior lever subassembly 21. Cover 48 is formed with an opening 206 which is also positioned on lever insert 24 at a location spaced from opening 204 of rose insert 32 and which serves as a second bearing support for exterior lever subassembly 21.

Cover 48 is formed with a flange 208 which fits radially inwardly of an overhanging rim 210 of rose insert 32 to preclude radially lateral movement of rose insert 32 and cover 48 relative to each other. Also, cover 48 is formed with a hub 212 which extends in an axial inboard direction. Hub 212 fits into the opening formed in the door for receipt of lockset 20 and precludes radially lateral movement of cover 48.

Referring now to the exploded view as illustrated in FIGS. 1 and 2, exterior lever 22 and interior lever 56 are arranged for a left hand door, that is, a door which is hinged on the left when viewed from the exterior of the door. In this arrangement, the handle portion of each of the levers 22 and 56 extend toward the hinged side of the door. Assume that one desires to change the hand of the door to a right hand. When changing a door from one hand to the other, e.g. left to right, the exterior and interior sides of the door remain unchanged. However, latch assembly 94 is moved from one vertical edge of the door to the other vertical edge. Thus, lever lockset 20 must be moved accordingly. Even so, it would appear that exterior lever insert 24 would remain on the exterior side of the door and interior lever insert 62 would remain on the interior side of the door.

As noted, the handle portion of levers 22 and 56 extend toward the hinged side of the door. Therefore, when changing the hand of the door, the levers 22 and 56 must be removed from their respective inserts 24 and 62 and rotated one hundred and eighty degrees to accommodate the hand change. However, when this is done, hole 104 of each lever 22 and 56 will be facing upwards for receipt of a set screw. Aesthetically, this is unacceptable. To rectify this situation, and since levers 22 and 56 are the mirror images of each other, lever 56 can now be used for assembly with exterior lever insert 24 and lever 22 can now be used for assembly with interior lever insert 62. In both instances, lever hole 104 will be located on the underside of the respective levers 22 or 56 and the handle portions will extend toward the hinged side of the door.

This demonstrates one of the versatile advantages of the generic hand design of the levers of this invention.

It is to be understood that the illustrated and above-described lever lockset 20 is of the privacy type. Other types, such as a passage type, use similar construction as the privacy type without departing from the spirit and scope of the invention. For example, in a passage type lever lockset, a passage lever, would not be formed with an outboard opening such as opening 100 of lever 22. Instead, the outboard surface of the lever in the area occupied by opening 100 would be covered and integral with the surface areas which are normally contiguous with the opening.

Further, in still other types of locksets, such as, for example, an entry or vestibule type, an exterior type lever, such as lever 22, and mating insert, such as insert 24, are used on an interior side of the door and a knob operator with a cylinder lock is used on the exterior side of the door. In the vestibule type, the lever has a dedicated half-round spindle and return spring which operates independently of operation of the knob. Use of the generic lever 22 or 56 in combination with the exterior type insert 24 in an entry or vestibule lockset does so without departing from the spirit and scope of this invention.

What is claimed is:

1. A door lock assembly comprising a pair of mirror imaged levers each including a horizontal handle portion and a hub portion having a thru bore extending therethrough and having a bottom portion and a set screw receiving hole extending vertically upwardly through said bottom portion to said thru bore, and a latch assembly including an exterior cylindrical hub having an end portion for insertion into the thru bore of one of said levers, an interior cylindrical hub having an end portion for insertion into the thru bore of the other of said levers, emergency plug means secured to said exterior cylindrical hub, the hub portion thru bore of each lever and each of said cylindrical hubs including cooperating means for preventing relative rotation between a lever and the cylindrical hub inserted into the thru bore of said lever, and a pair of diametrically, vertically opposed set screw receiving holes in each of said cylindrical hubs selectively located so that when one of said cylindrical hubs is inserted into either of said lever hub portion thru bores said pair of opposed cylindrical hub set screw receiving holes will be in vertical alignment with said set screw receiving hole of said lever, so that said pair of levers can be secured to said cylindrical hubs with said lever set screw receiving hole at the bottom of said lever when the door is either a left hand door or a right hand door.

2. A door lock assembly according to claim 1, further comprising means for preventing the operation of said latch assembly including turn button means secured to said interior cylindrical hub.

3. A door lock assembly according to claim 2, wherein said turn button means comprises a turn button insert and a turn button insert cover.

4. A door lock assembly according to claim 2, wherein said emergency plug means comprises an emergency plug and an emergency plug cover.

* * * * *